US010644428B2

(12) United States Patent
Sundarakrishnamachari et al.

(10) Patent No.: US 10,644,428 B2
(45) **Date of Patent: *May 5, 2020**

(54) CONNECTOR ASSEMBLY WITH TERMINAL-STABILIZER

(71) Applicant: Aptiv Technologies Limited, St. Michael (BB)

(72) Inventors: Rangarajan Sundarakrishnamachari, Chennai (IN); Sivakumar Jogula, Chennai (IN); John D. Schneider, Warren, OH (US); Bart N. Caldwell, West Farmington, OH (US)

(73) Assignee: Aptiv Technolgies Limited (BB)

( * ) Notice: Subject to any disclaimer, the term of this patent is extended or adjusted under 35 U.S.C. 154(b) by 0 days.

This patent is subject to a terminal disclaimer.

(21) Appl. No.: 16/668,430

(22) Filed: Oct. 30, 2019

(65) Prior Publication Data

US 2020/0067226 A1 Feb. 27, 2020

Related U.S. Application Data

(63) Continuation of application No. 16/002,564, filed on Jun. 7, 2018, now Pat. No. 10,498,066.

(51) Int. Cl.
*H01R 13/44* (2006.01)
*H01R 13/426* (2006.01)

(52) U.S. Cl.
CPC ..... *H01R 13/426* (2013.01)

(58) Field of Classification Search
CPC ..... H01R 13/4538
USPC ..... 439/140, 141
See application file for complete search history.

(56) References Cited

U.S. PATENT DOCUMENTS 5,389,007 A 2/1995 Reinelt
7,267,562 B2 9/2007 Katsuma
10,498,066 B1 * 12/2019 Sundarakrishnamachari ..... H01R 13/426

* cited by examiner

*Primary Examiner* — Phuong K Dinh
(74) *Attorney, Agent, or Firm* — Robert J. Myers

(57) ABSTRACT

A connector assembly includes a first-connector-housing, an inner-housing, a terminal-stabilizer, and a second-connector-housing. The inner-housing is disposed within a cavity defined by the first-connector-housing. The inner-housing includes an opposed flexible-lock moveable from a locked-position to an unlocked-position. The terminal-stabilizer is disposed within the cavity and is movable from a pre-stage-position to a seated-position. The terminal-stabilizer defines a stop configured to engage an end of the opposed flexible-lock when the opposed flexible-lock is in the locked-position. The second-connector-housing includes an unlocking-feature configured to move the opposed flexible-lock from the locked-position to the unlocked-position. When the second-connector-housing is mated with the first-connector-housing the unlocking-feature moves the opposed flexible-lock to the unlocked-position, whereby the stop on the terminal-stabilizer moves past the opposed flexible-lock and the second-connector-housing moves the terminal-stabilizer from the pre-stage-position to the seated-position.

14 Claims, 7 Drawing Sheets

CONNECTOR ASSEMBLY WITH TERMINAL-STABILIZER

CROSS-REFERENCE TO RELATED APPLICATION

This is a continuation application and claims the benefit under 35 U.S.C. § 120 of U.S. patent application Ser. No. 16/002,564, filed Jun. 7, 2018, the entire disclosure of which is hereby incorporated herein by reference.

TECHNICAL FIELD OF INVENTION

This disclosure generally relates to an electrical connector assembly, and more particularly relates to an electrical connector assembly with a terminal-stabilizer feature.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1:
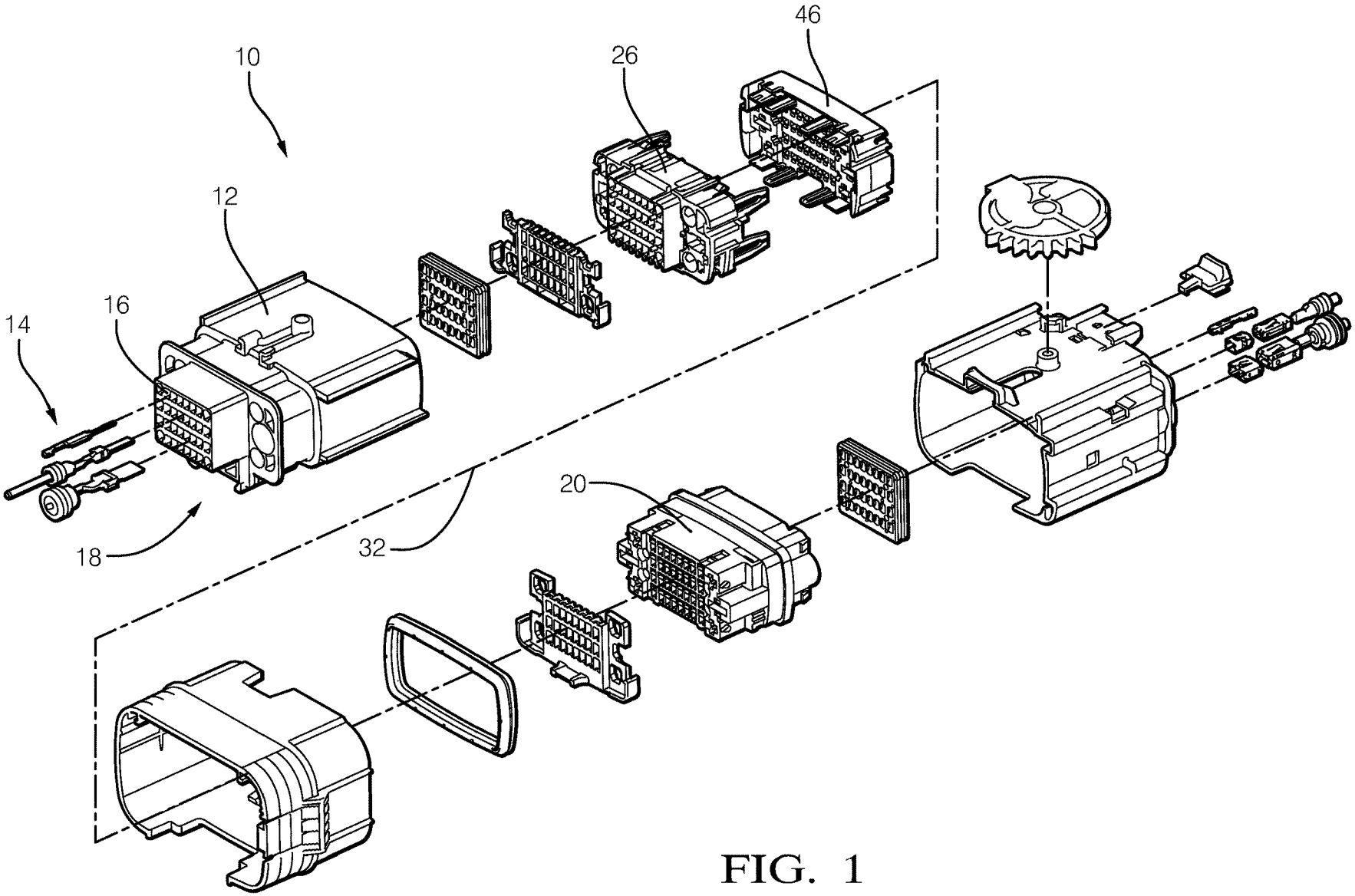
FIG. 1 is an exploded perspective view of a connector assembly in accordance with one embodiment.

FIG. 1 illustrates a connector assembly 10, hereafter referred to as the assembly 10. The assembly 10 includes a first-connector-housing 12 configured to receive a plurality of electrical-terminals 14 through a plurality of first-apertures 16 defined by a terminal-end 18 of the first-connector-housing 12. The first-connector-housing 12 is formed of a polymeric dielectric material. The polymeric dielectric material may be any polymeric dielectric material capable of electrically isolating portions of the plurality of electrical-terminals 14, and is preferably a polyamide (NYLON) material. The plurality of electrical-terminals 14 are configured to mate with corresponding electrical-terminals (not specifically shown) of a second-connector-housing 20. The plurality of electrical-terminals 14 are formed of an electrically conductive material, such as a copper-based alloy that may also include a coating of another conductive material (e.g. tin-based, silver-based coating). The plurality of electrical-terminals 14 and the plurality of corresponding electrical-terminals are configured to be attached to wire cables (not specifically shown) that may be a component of a wiring-harness of a vehicle.

Figure 2A:
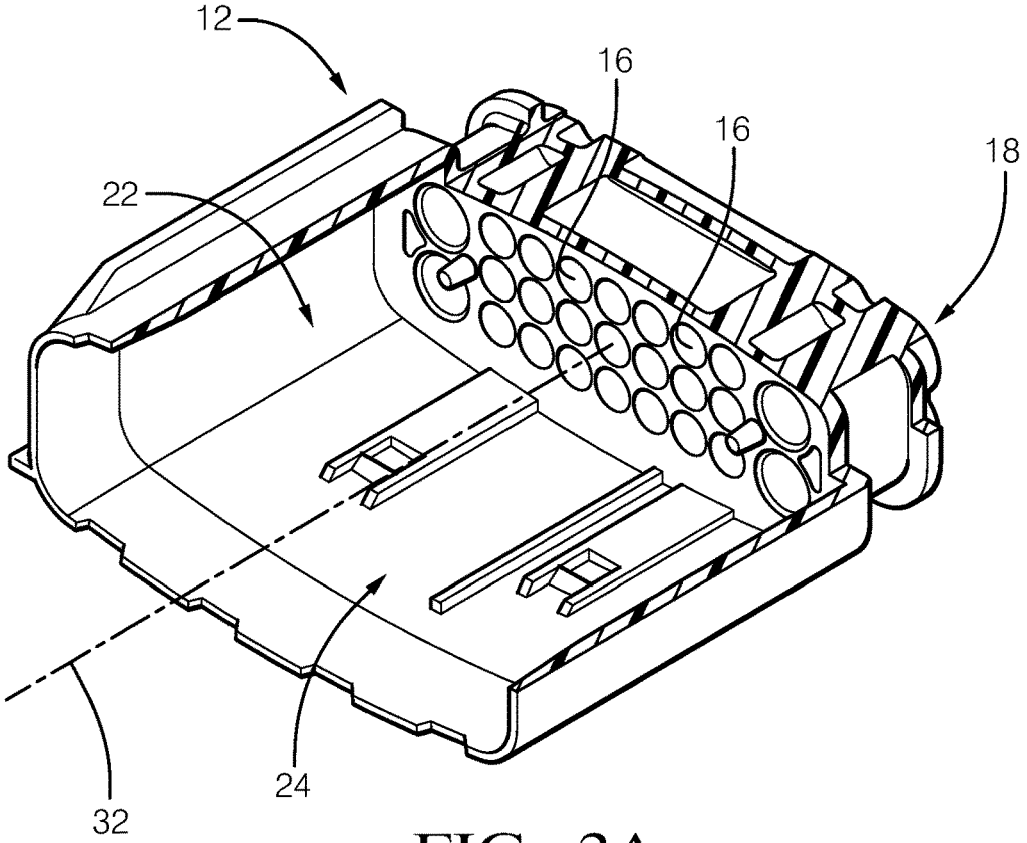
FIG. 2A is a section view of a first-connector-housing of the connector assembly isolated from the assembly of FIG. 1 in accordance with one embodiment.
Figure 2B:
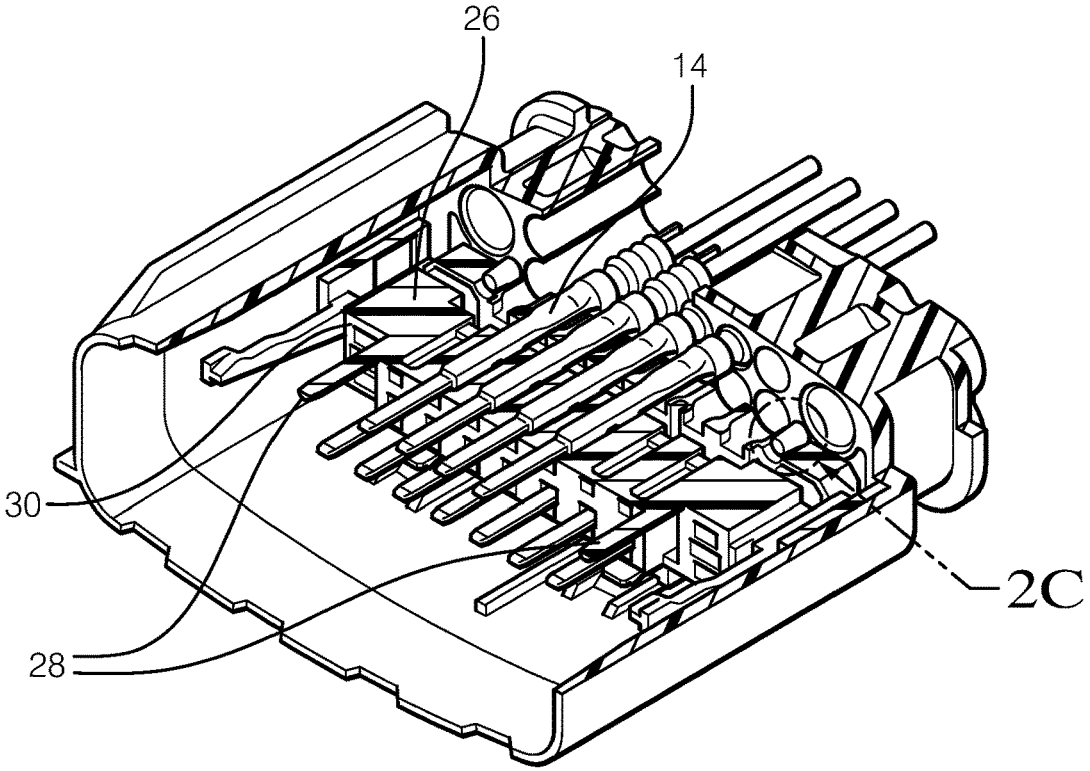
FIG. 2B is another section view of the first-connector-housing of FIG. 2A with an inner-housing isolated from the assembly of FIG. 1 in accordance with one embodiment.

FIG. 2A illustrates a section view of the first-connector-housing 12 isolated from the assembly 10 where a portion of the first-connector-housing 12 is removed. The first-connector-housing 12 defines a cavity 22 having an inner-surface 24. FIG. 2B illustrates a section view of an inner-housing 26 disposed within the cavity 22 configured to retain the plurality of electrical-terminals 14 within the cavity 22. The inner-housing 26 is formed of a polymeric dielectric material, and is preferably a polyamide (NYLON) material. The inner-housing 26 includes a plurality of first-alignment-rods 28 extending from a first-face 30 of the inner-housing 26 along a mating-axis 32 of the assembly 10 in a direction away from the terminal-end 18.

Figure 2C:
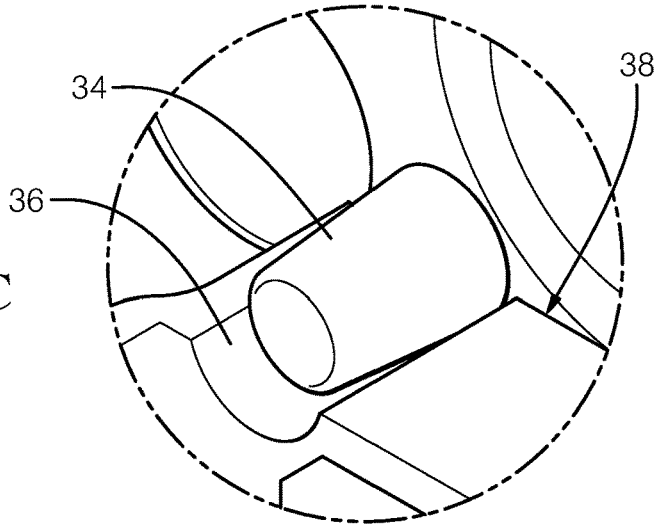
FIG. 2C is a close-up of the section-view FIG. 2B in accordance with one embodiment.

FIG. 2C illustrates a close-up view of a portion of an interface between the first-connector-housing 12 and the inner-housing 26. The inner-housing 26 is aligned to the first-connector-housing 12 with a plurality of second-alignment-rods 34 extending from the first-connector-housing 12 into a plurality of second-apertures 36 defined by a second-face 38 of the inner-housing 26. Having proper alignment between the first-connector-housing 12 and the inner-housing 26 is critical because improper alignment may lead to a misalignment of the plurality of electrical-terminals 14 with the plurality of corresponding electrical-terminals and result in a poor electrical-connection. Improper alignment may also cause uneven cable-seal compression and/or electrical-terminal-stubbing during insertion and/or damage to the plurality of electrical-terminals 14 during disassembly of the assembly 10.

Figure 3A:
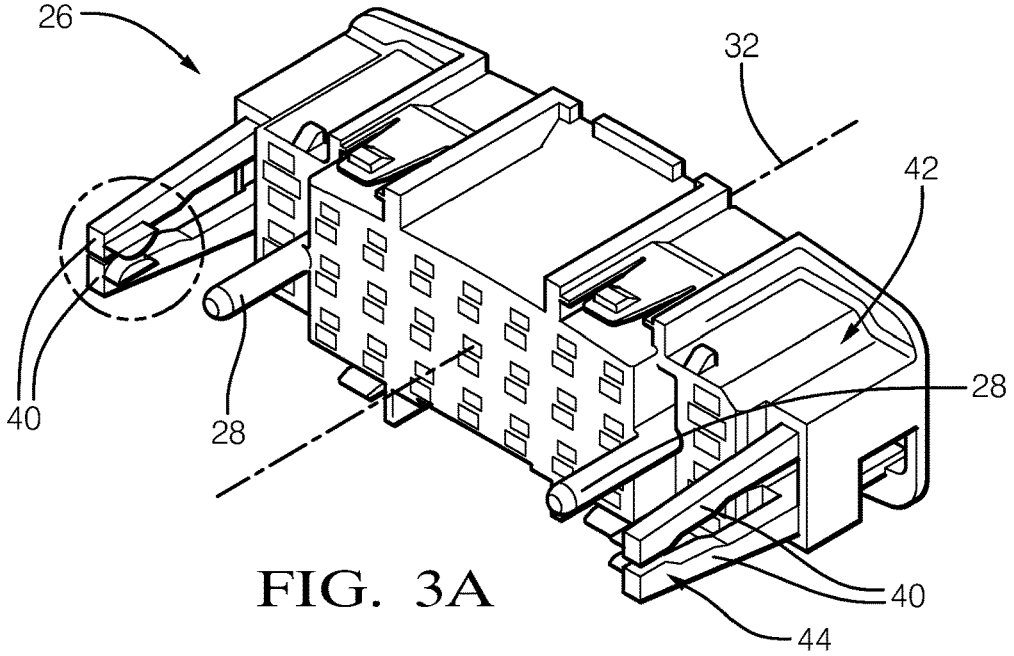
FIG. 3A is a perspective view of the inner-housing isolated from the assembly of FIG. 1 in accordance with one embodiment.
Figure 3B:
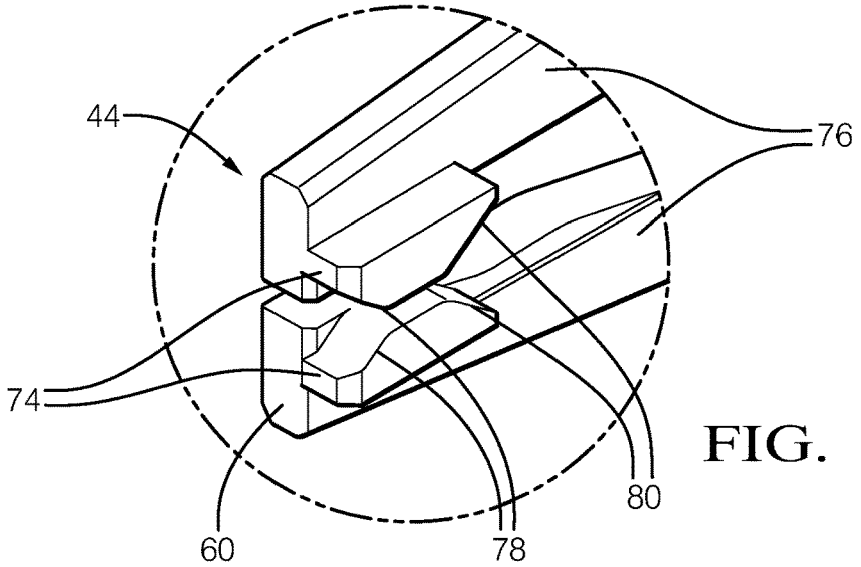
FIG. 3B is a close-up perspective view of a pair of opposed flexible-locks of FIG. 3A in accordance with one embodiment.

FIG. 3A illustrates the inner-housing 26 isolated from the assembly 10. The inner-housing 26 includes a pair of opposed flexible-locks 40 extending along the mating-axis 32 from an outer-surface 42 of the inner-housing 26 in the direction away from the terminal-end 18 of the first-connector-housing 12 and overlaying the inner-surface 24 of the first-connector-housing 12 (see FIG. 2B). The pair of opposed flexible-locks 40 are moveable from a locked-position 44 to an unlocked-position 46, as will be described in more detail below. In the examples illustrated in FIGS. 3A-3B, the pair of opposed flexible-locks 40 are in the locked-position 44.

Figure 4A:
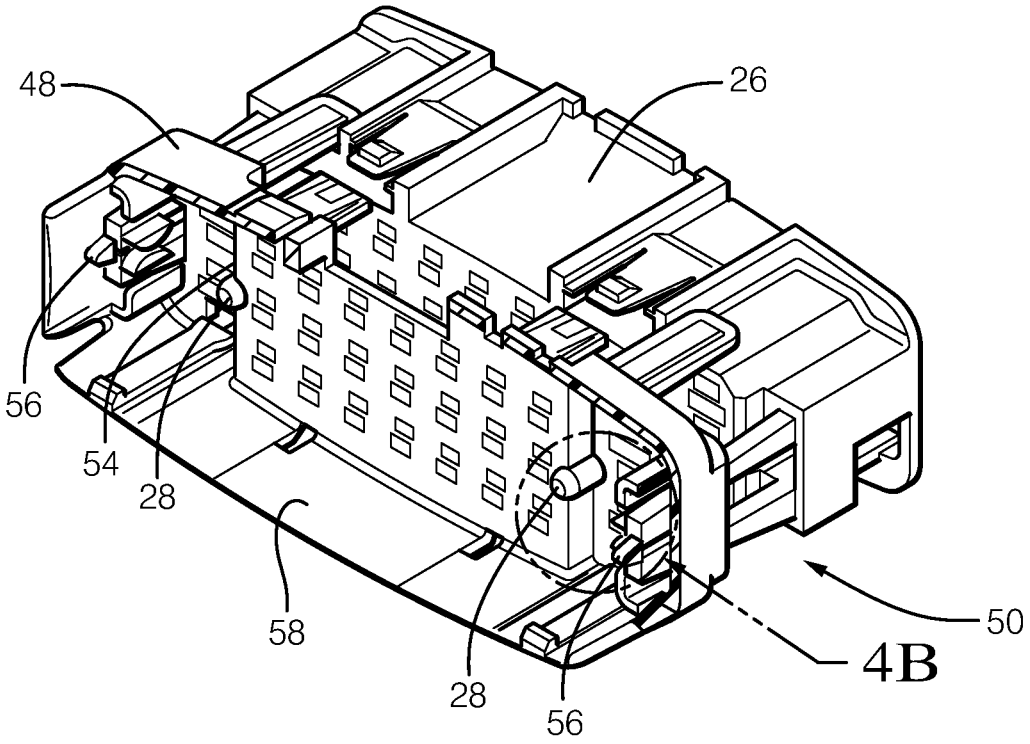
FIG. 4A is a perspective view of the inner-housing and the terminal-stabilizer isolated from the assembly of FIG. 1 in accordance with one embodiment.
Figure 4B:
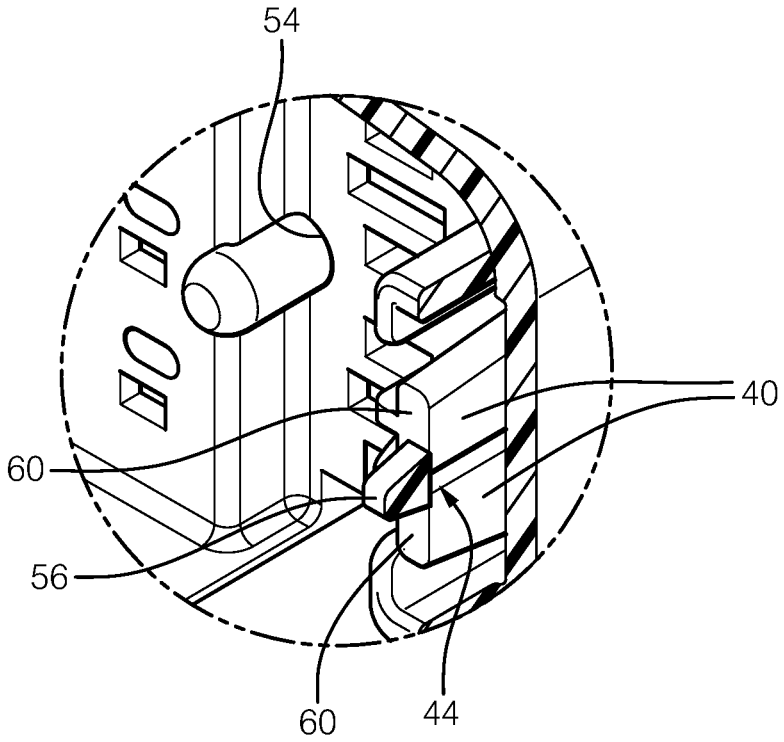
FIG. 4B is a close-up view of a portion of the inner-housing and the terminal-stabilizer of FIG. 4A in accordance with one embodiment.
Figure 5:
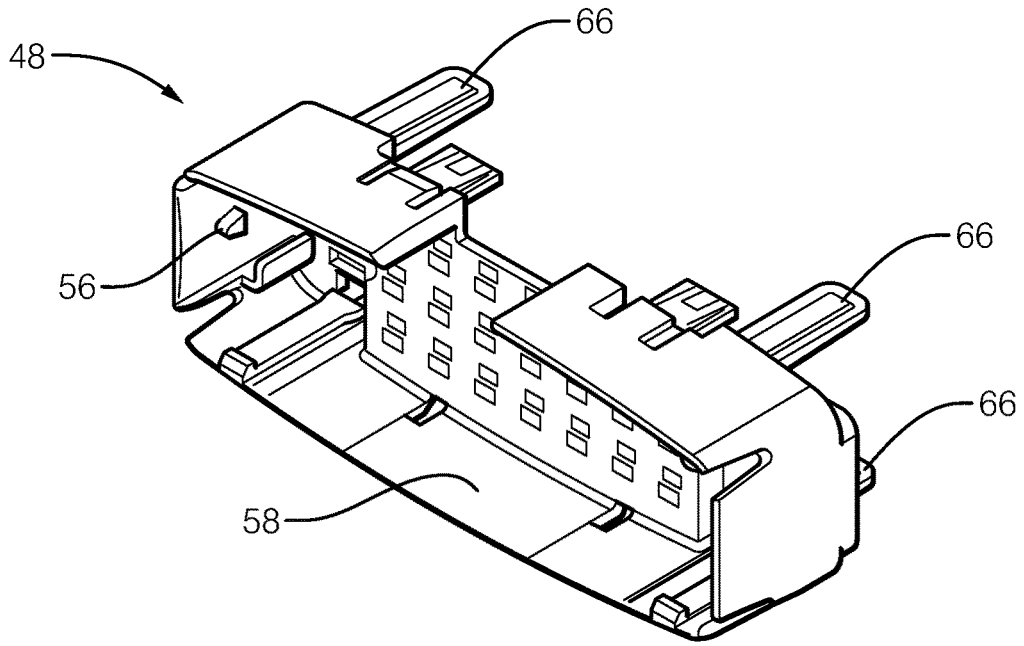
FIG. 5 is a perspective view of the terminal-stabilizer isolated from the assembly of FIG. 1 in accordance with one embodiment.
Figure 6A:
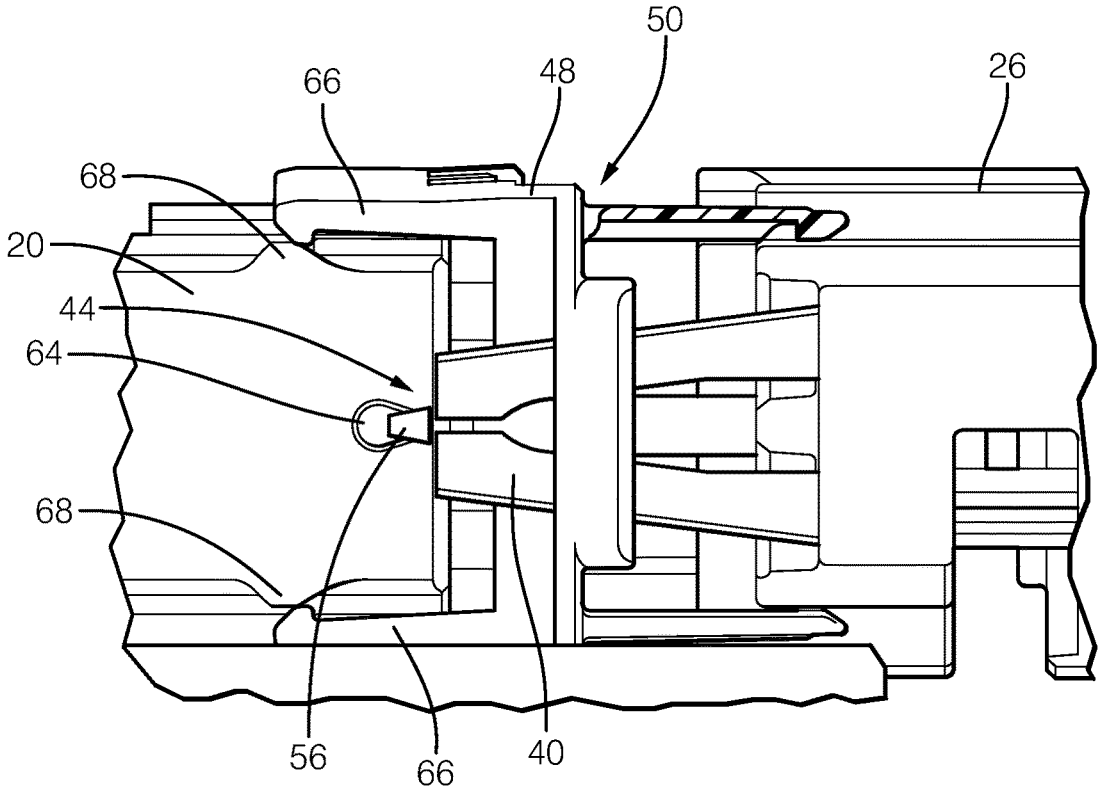
FIG. 6A is a segment of a mating sequence of the assembly in accordance with one embodiment.
Figure 6B:
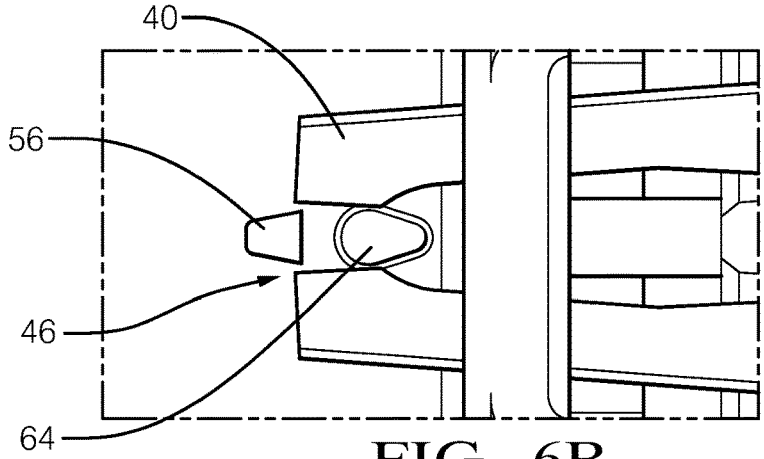
FIG. 6B is another segment of a mating sequence of the assembly in accordance with one embodiment.
Figure 6C:
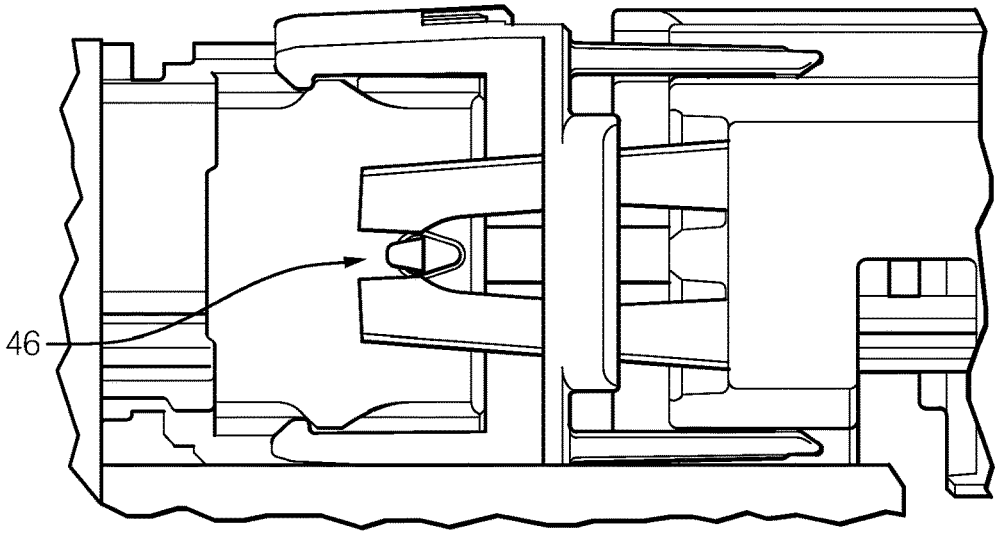
FIG. 6C is yet another segment of a mating sequence of the assembly in accordance with one embodiment.
Figure 6D:
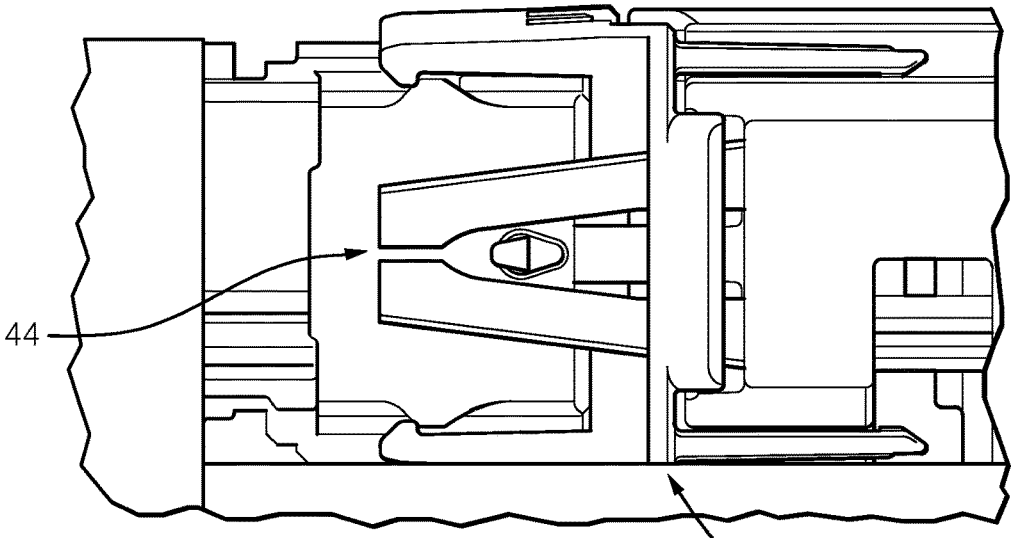
FIG. 6D is yet another segment of a mating sequence of the assembly in accordance with one embodiment.

FIG. 4A illustrates a terminal-stabilizer 48 releasably locked to the inner-housing 26 and isolated from the assembly 10. The terminal-stabilizer 48 is also disposed within the cavity 22 and is configured to support the plurality of electrical-terminals 14 extending beyond the first-face 30 of the inner-housing 26. The terminal-stabilizer 48 is formed of a polymeric dielectric material, and is preferably a polyamide (NYLON) material, and is movable from a pre-stage-position 50 to a seated-position 52 (see FIG. 6D). The terminal-stabilizer 48 slideably engages the plurality of first-alignment-rods 28 extending through third-apertures 54 defined by the terminal-stabilizer 48 when the terminal-stabilizer 48 is moved from the pre-stage-position 50 to the seated-position 52. The terminal-stabilizer 48 defines a pair of stops 56 extending inward from a perimeter-skirt 58 of the terminal-stabilizer 48 configured to engage ends 60 of the pair of opposed flexible-locks 40 when the pair of opposed flexible-locks 40 are in the locked-position 44, thereby inhibiting a movement of the terminal-stabilizer 48 to the seated-position 52. A portion of the perimeter-skirt 58 has been cut-away from the terminal-stabilizer 48 in FIGS. 4A-4B to more clearly illustrate the a pair of stops 56 interacting with the pair of opposed flexible-locks 40. FIG. 5 illustrates the terminal-stabilizer 48 isolated form the assembly 10 with the perimeter-skirt 58 intact.

FIGS. 6A-6D illustrate a progression of a mating sequence of the assembly 10. A section view of the assembly 10 is shown without the plurality of electrical-terminals 14 to more clearly illustrate the interaction between the components. The second-connector-housing 20 includes a pair of unlocking-features 64 (see FIG. 6A) configured to move the pair of opposed flexible-locks 40 from the locked-position 44 to the unlocked-position 46 (see FIG. 6B). The mating sequence illustrates that when the second-connector-housing 20 is mated with the first-connector-housing 12 the pair of unlocking-features 64 move the pair of opposed flexible-locks 40 to the unlocked-position 46, whereby the pair of stops 56 on the terminal-stabilizer 48 move past the pair of opposed flexible-locks 40 (see FIG. 6C) and the second-connector-housing 20 moves the terminal-stabilizer 48 from the pre-stage-position 50 (see FIG. 6A) to the seated-position 52 (see FIG. 6D). The pair of opposed flexible-locks 40 return to the locked-position 44 when the first-connector-housing 12 is mated with the second-connector-housing 20 and the terminal-stabilizer 48 is in the seated-position 52. This is beneficial because in the locked-position 44 the pair of opposed flexible-locks 40 are in a zero-stress state (i.e. relaxed state), which increases a durability of the pair of opposed flexible-locks 40. It will be appreciated that the pair of unlocking-features 64 on the second-connector-housing 20 are configured to operate the pair of opposed flexible-locks 40 from the locked-position 44 (FIG. 6D—when the terminal-stabilizer 48 is in the seated-position 52) to the unlocked-position 46 when the second-connector-housing 20 is un-mated from the first-connector-housing 12. The pair of opposed flexible-locks 40 also return to the locked-position 44 (i.e. the relaxed state) when the first-connector-housing 12 is un-mated from the second-connector-housing 20 and the terminal-stabilizer 48 is returned to the pre-stage-position 50.

Referring again to FIG. 6A, the terminal-stabilizer 48 includes a plurality of retraction-fingers 66 extending from the perimeter-skirt 58 toward the second-connector-housing 20. The plurality of retraction-fingers 66 are configured to engage a plurality of retraction-locks 68 extending from an outside-surface of the second-connector-housing 20. The second-connector-housing 20 returns the terminal-stabilizer 48 to the pre-stage-position 50 when the second-connector-housing 20 is un-mated from the first-connector-housing 12. This is a beneficial feature because returning the terminal-stabilizer 48 to the pre-stage-position 50 protects the plurality of electrical-terminals 14 when the assembly 10 is unmated.

Figure 7A:
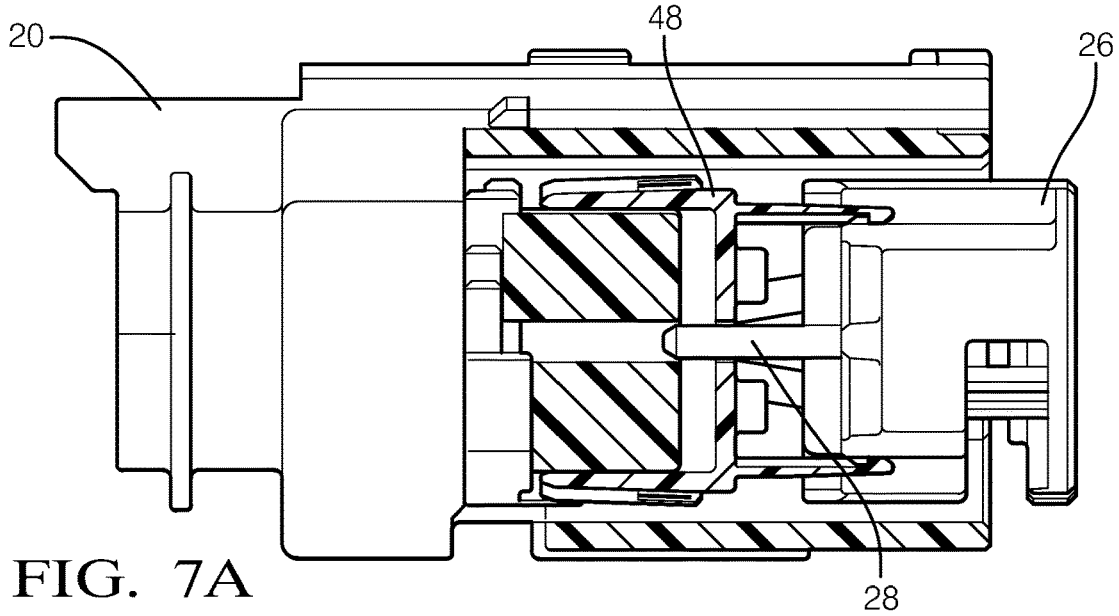
FIG. 7A is a section view of the assembly if FIG. 1 illustrating a plurality of first-alignment-rods in accordance with one embodiment.
Figure 7B:
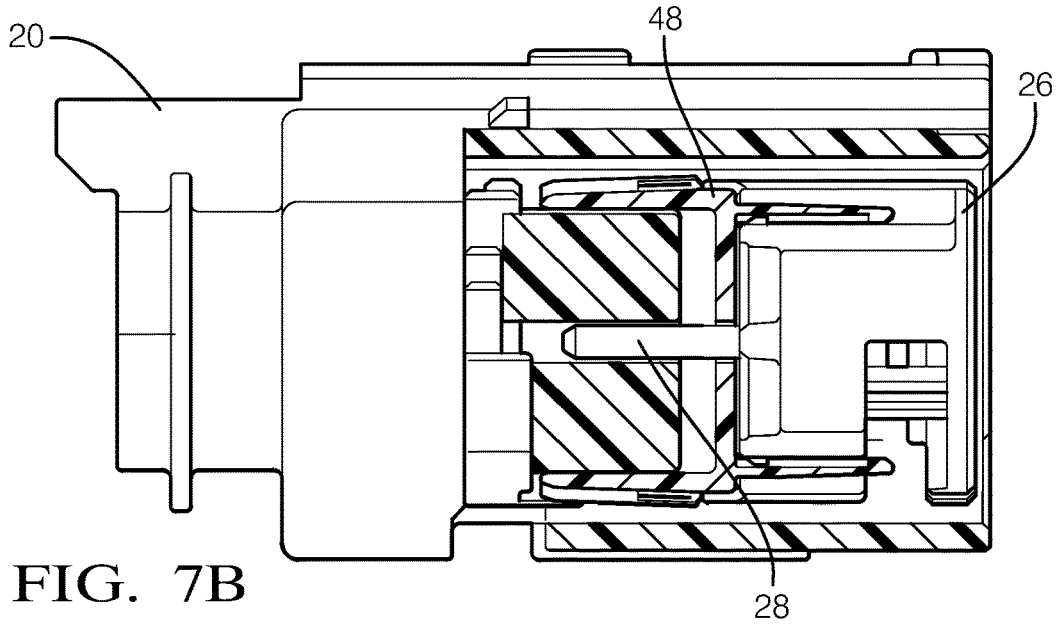
FIG. 7B is another section view of the assembly if FIG. 7A illustrating the plurality of first-alignment-rods in accordance with one embodiment.

FIGS. 7A-7B are a section view of the assembly 10 and illustrate the plurality of first-alignment-rods 28 aligning the inner-housing 26 with both the terminal-stabilizer 48 and the second-connector-housing 20 when the first-connector-housing 12 is mated with the second-connector-housing 20. This alignment is beneficial because it enables a uniform compression of a connector-seal (see FIG. 1—not specifically shown) that seals between the first-connector-housing 12 and the second-connector-housing 20.

Figure 8:
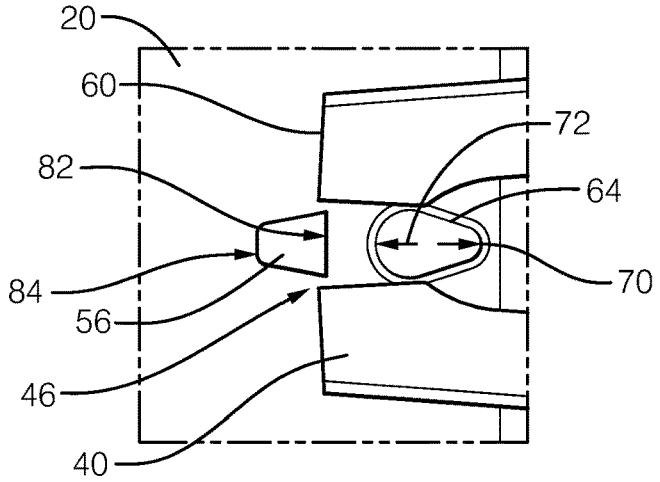
FIG. 8 is a close-up view of FIG. 6B illustrating an unlocking-feature and a stop in accordance with one embodiment.

FIG. 8 is a close-up view of a portion of one side of the assembly 10 illustrating the stop 56 and the unlocking-feature 64. The pair of unlocking-features 64 of the second-connector-housing 20 are characterized as having a generally cam-shaped profile that includes first-radii 70 and second-radii 72 greater than the first-radii 70. The pair of unlocking-features 64 are positioned on the second-connector-housing 20 such that the first-radii 70 engage the pair of opposed flexible-locks 40 prior to the second-radii 72 enabling the pair of opposed flexible-locks 40 to move from the locked-position 44 to the unlocked-position 46 when the first-connector-housing 12 is mated with the second-connector-housing 20. When the first-connector-housing 12 is un-mated from the second-connector-housing 20, the pair of unlocking-features 64 are positioned on the second-connector-housing 20 such that the second-radii 72 engage the pair of opposed flexible-locks 40 prior to the first-radii 70 enabling the pair of opposed flexible-locks 40 to move from the locked-position 44 to the unlocked-position 46.

Referring back to FIG. 3B, the pair of opposed flexible-locks 40 define a pair of opposed unlocking-lugs 74 extending inward from inboard-sides 76 of the pair of opposed flexible-locks 40 and positioned proximate the ends 60. The pair of opposed unlocking-lugs 74 define first-chamfers 78, wherein the first-radii 70 of the pair of unlocking-features 64 engage the first-chamfers 78 when the first-connector-housing 12 is mated with the second-connector-housing 20. The pair of opposed unlocking-lugs 74 further define second-chamfers 80, wherein the second-radii 72 of the pair of unlocking-features 64 engage the second-chamfers 80 when the first-connector-housing 12 is un-mated from the second-connector-housing 20. Angles of the first-chamfers 78 and the second-chamfers 80 may be determined based on the first-radii 70 and the second-radii 72 to obtain a desired engagement-force between the features.

Referring back to FIG. 8, the pair of stops 56 of the terminal-stabilizer 48 are characterized as having a generally isosceles trapezoidal-shaped profile with first-bases 82 longer than second-bases 84. The pair of stops 56 are positioned on the terminal-stabilizer 48 such that the first-bases 82 engage the ends 60 of the pair of opposed flexible-locks 40 when the pair of opposed flexible-locks 40 are in the locked-position 44.

Accordingly, a connector assembly 10 is provided. The connector assembly 10 is an improvement over prior art connector-assemblies because the connector assembly 10 includes alignment features that improve the mating of the assembly 10, as well as the terminal-stabilizer 48 moveable from the locked-position 44 to the unlocked-position 46 that protects the plurality of electrical-terminals 14 when the assembly 10 is un-mated.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. A connector assembly, comprising:

a first-connector-housing defining a cavity and configured to receive an electrical-terminal;

an inner-housing disposed within the cavity configured to retain the electrical-terminal within the cavity, wherein the inner-housing further includes an opposed flexible-lock that is moveable from a locked-position to an unlocked-position and extending along a mating-axis;

a terminal-stabilizer disposed within the cavity and releasably locked to the inner-housing, the terminal-stabilizer configured to support the electrical-terminal extending beyond the first-face of the inner-housing, wherein the terminal-stabilizer is movable from a pre-stage-position to a seated-position, wherein the terminal-stabilizer defines a stop extending inward from a perimeter-skirt of the terminal-stabilizer configured to engage ends of the opposed flexible-lock when the opposed flexible-lock is in the locked-position, thereby inhibiting a movement of the terminal-stabilizer to the seated-position, and wherein the first-connector-housing is configured to mate with a second-connector-housing including an unlocking-feature configured to move the opposed flexible-lock from the locked-position to the unlocked-position, and the unlocking-feature moves the opposed flexible-lock to the unlocked-position when the second-connector-housing is mated with the first-connector-housing, whereby the stop on the terminal-stabilizer moves past the opposed flexible-lock and the second-connector-housing moves the terminal-stabilizer from the pre-stage-position to the seated-position.

2. The connector assembly in accordance with claim 1, wherein the inner-housing includes a first-alignment-rod extending from a first-face of the inner-housing along the mating-axis of the connector assembly and wherein the terminal-stabilizer slideably engages the first-alignment-rod extending through second-apertures defined by the terminal-stabilizer when the terminal-stabilizer is moved from the pre-stage-position to the seated-position.

3. The connector assembly in accordance with claim 2, wherein the inner-housing is aligned to the first-connector-housing with a second-alignment-rod extending from the first-connector-housing into a second-aperture defined by a second-face of the inner-housing.

4. The connector assembly in accordance with claim 1, wherein the terminal-stabilizer includes a retraction-finger extending from the perimeter-skirt toward the second-connector-housing, the retraction-finger configured to engage a retraction-lock extending from an outer-surface of the second-connector-housing, wherein the second-connector-housing returns the terminal-stabilizer to the pre-stage-position when the second-connector-housing is un-mated from the first-connector-housing.

5. The connector assembly in accordance with claim 1, wherein the first-alignment-rod aligns the inner-housing with the terminal-stabilizer when the first-connector-housing is mated with the second-connector-housing.

6. The connector assembly in accordance with claim 1, wherein the first-alignment-rod aligns the inner-housing with the second-connector-housing when the first-connector-housing is mated with the second-connector-housing.

7. The connector assembly in accordance with claim 1, wherein the opposed flexible-lock returns to the locked-position when the first-connector-housing is mated with the second-connector-housing and the terminal-stabilizer is in the seated-position.

8. The connector assembly in accordance with claim 1, wherein the opposed flexible-lock returns to the locked-position when the first-connector-housing is un-mated from the second-connector-housing and the terminal-stabilizer is in the pre-stage-position.

9. The connector assembly in accordance with claim 1, wherein the opposed flexible-lock defines an opposed unlocking-lug extending inward from inboard-side of the opposed flexible-lock and positioned proximate the ends, the opposed unlocking-lug defining a first-chamfer, wherein a first-radii of the unlocking-feature engages the first-chamfer when the first-connector-housing is mated with the second-connector-housing.

10. The connector assembly in accordance with claim 9, wherein the opposed unlocking-lug further defines a second-chamfer, wherein a second-radii of the unlocking-feature engages the second-chamfer when the first-connector-housing is unmated from the second-connector-housing.

11. The connector assembly in accordance with claim 1, wherein the stop of the terminal-stabilizer is characterized as having a generally isosceles trapezoidal-shaped profile with a first-base longer than a second-base.

12. The connector assembly in accordance with claim 11, wherein the stop is positioned on the terminal-stabilizer such that the first-base engages the ends of the opposed flexible-lock when the opposed flexible-lock is in the locked-position.

13. A connector assembly, comprising:

a first-connector-housing;

an inner-housing disposed within the first-connector-housing, wherein the inner-housing includes flexible-locks that are moveable from a locked-position to an unlocked-position; and a terminal-stabilizer disposed within the first-connector-housing and releasably locked to the inner-housing, wherein the terminal-stabilizer is movable from a pre-stage-position to a seated-position, wherein the terminal-stabilizer defines stops extending inward from a skirt of the terminal-stabilizer configured to engage ends of the flexible-locks in the locked-position, and wherein the first-connector-housing is configured to be mated with a second-connector-housing including an unlocking-feature configured to move the flexible-locks from the locked-position to the unlocked-position, wherein the unlocking-feature moves the flexible-locks to the unlocked-position when the second-connector-housing is mated with the first-connector-housing, whereby the stops on the terminal-stabilizer move past the flexible-locks and the second-connector-housing moves the terminal-stabilizer from the pre-stage-position to the seated-position.

14. A connector assembly, comprising:

a second-connector-housing including an unlocking-feature, the second-connector-housing configured to mate with a first-connector-housing having an inner-housing disposed within the first-connector-housing, the inner-housing including flexible-locks that are moveable from a locked-position to an unlocked-position, a terminal-stabilizer is disposed within the first-connector-housing and releasably locked to the inner-housing, the terminal-stabilizer movable from a pre-stage-position to a seated-position, wherein the terminal-stabilizer defines stops extending inward from a skirt of the terminal-stabilizer configured to engage ends of the flexible-locks in the locked-position, wherein the unlocking-feature is configured to move the flexible-locks from the locked-position to the unlocked-position, wherein the unlocking-feature moves the flexible-locks to the unlocked-position when the second-connector-housing is mated with the first-connector-housing, whereby the stops on the terminal-stabilizer move past the flexible-locks and the second-connector-housing moves the terminal-stabilizer from the pre-stage-position to the seated-position.

* * * * *